US006142916A

United States Patent [19]

Byrd

[11] Patent Number: 6,142,916

[45] Date of Patent: Nov. 7, 2000

[54] VARIABLE ROTATIONAL EXERCISE SYSTEM

[75] Inventor: Richard H. Byrd, San Francisco, Calif.

[73] Assignee: Corp. X Development, Inc., San Francisco, Calif.

[21] Appl. No.: 09/141,872

[22] Filed: Aug. 27, 1998

[51] Int. Cl.[7] ..... A63B 22/06

[52] U.S. Cl. ..... 482/57; 482/62; 74/594.2; 74/594.6

[58] Field of Search ..... 482/57, 60, 62, 482/80, 148; 74/594.1, 594.2, 594.3, 594.4, 594.5, 594.6, 594.7

[56] References Cited

U.S. PATENT DOCUMENTS

| | | | |
|---|---|---|---|
| 4,140,312 | 2/1979 | Buchmann | 272/73 |
| 4,509,742 | 4/1985 | Cones | 272/73 |
| 4,638,685 | 1/1987 | Cigolini | 74/594.6 |
| 4,657,244 | 4/1987 | Ross | 272/73 |
| 4,741,527 | 5/1988 | Nestegard | 272/73 |
| 4,880,225 | 11/1989 | Lucas et al. | 272/73 |
| 4,973,046 | 11/1990 | Maxwell | 272/73 |
| 5,170,574 | 12/1992 | Weisbrich | 36/131 |

*Primary Examiner*—Jerome W. Donnelly
*Assistant Examiner*—Tam Nguyen
*Attorney, Agent, or Firm*—Haverstock & Owens LLP

[57] ABSTRACT

An exercise system and method is utilized with a foot pedal of a stationary bicycle to exercise various body parts including the user's legs, arms, chest, shoulders, back, and abdomen for a complete body workout. The exercise system preferably includes an adapter and a plurality of user interfaces. The adapter is configured to releasably couple one of the foot pedals of the stationary bicycle and one of the plurality of user interfaces. A foot holder serves as one of the plurality of user interfaces. Preferably, the foot holder securely and releasably retains the user's foot. While in use, the user's foot is axially aligned with an axle of the foot pedal and is capable of supplying force to the foot pedal on both the down-stroke and up-stroke portions of the foot pedal's rotation. An external attachment also serves as one of the plurality of user interfaces. The external attachment is preferably designed to transmit force from the user's legs, arms, feet, or hands to the foot pedal of the stationary bicycle. Additionally, the external attachment can also transmit force from the user's legs, arms, feet, or hands to this foot pedal. Similar to the foot holder, the external attachment is also capable of supplying force to the foot pedal on both the down-stroke and up-stroke portions of the foot pedal's rotation.

10 Claims, 7 Drawing Sheets

VARIABLE ROTATIONAL EXERCISE SYSTEM

FIELD OF THE INVENTION

This invention relates to the field of exercise devices. More particularly, this invention relates to exercise attachments that are used in conjunction with stationary bicycles.

BACKGROUND OF THE INVENTION

It is well known that in the past, people relied on traditional bicycles as transportation devices. Although still a transportation device to many people, today there are increasing numbers of people riding bicycles for health benefits associated with exercise. Unfortunately, it is sometimes inconvenient and/or dangerous to ride a traditional bicycle.

Stationary bicycles allow people to exercise in a manner similar to riding an ordinary bicycle. The bicycle rider utilizing either a traditional bicycle or a stationary bicycle conventionally sits on a bicycle seat, holds a handlebar, and exerts force on both foot pedals. However, unlike traditional bicycles, stationary bicycles allow the user to remain fixed in one location while the user pedals the stationary bicycle. By utilizing a stationary bicycle, the user is not exposed to potential hazards such as crashing into objects or encountering inclement weather. Unlike traditional bicycles, stationary bicycles are more convenient for exercise because the user is capable of terminating the exercise at any time unlike a traditional bicycle rider which needs to consider his/her present physical location.

Similar to traditional bicycles, stationary bicycles typically employ two foot pedals for the user's feet to exert force against. To operate the stationary bicycle, the user exerts force onto one foot pedal of the bicycle at a time in an alternating fashion. It is possible for the user to only exert force onto one foot pedal. However, by exerting force only onto one foot pedal, stationary bicycles typically operate in a jerky, uneven manner because force can only be exerted onto the foot pedal during a down-stroke portion of the foot pedal's rotation. Further, typical stationary bicycles are not designed to allow the user to exercise different body parts such as arms, chest, and abdomen for a complete body exercise while utilizing the foot pedals.

What is needed is an exercise system that is utilized with a foot pedal of a stationary bicycle and targets various body parts including the user's legs, arms, chest, shoulders, back, and abdomen to provide the user with a complete body workout.

SUMMARY OF THE INVENTION

An exercise system and method is utilized with a foot pedal of a stationary bicycle to exercise various body parts including the user's legs, arms, chest, shoulders, back, and abdomen for a complete body workout. The exercise system preferably includes an adapter and a plurality of user interfaces. The adapter is configured to releasably couple one of the foot pedals of the stationary bicycle and one of the plurality of user interfaces. A foot holder serves as one of the plurality of user interfaces. Preferably, the foot holder securely and releasably retains the user's foot. While in use, the user's foot is axially aligned with an axle of the foot pedal and is capable of supplying force to the foot pedal on both the down-stroke and up-stroke portions of the foot pedal's rotation. An external attachment also serves as one of the plurality of user interfaces. The external attachment is preferably designed to transmit force from the user's leg, arm, foot, or hand to the foot pedal of the stationary bicycle. Additionally, the external attachment can also transmit force from the user's legs, arms, feet, or hands to this foot pedal. Similar to the foot holder, the external attachment is also capable of supplying force to the foot pedal on both the down-stroke and up-stroke portions of the foot pedal's rotation.

DETAILED DESCRIPTION OF THE PREFERRED EMBODIMENTS

When utilized in conjunction with a stationary bicycle, the present invention allows the user to exercise various muscle groups associated with the legs, arms, shoulders, back, and chest, without riding a stationary bicycle in a conventional manner. The present invention is capable of targeting multiple muscle groups without requiring cumbersome, time-consuming equipment setup. In addition, the present invention is also easily capable of targeting individual muscles.

Figure 1:
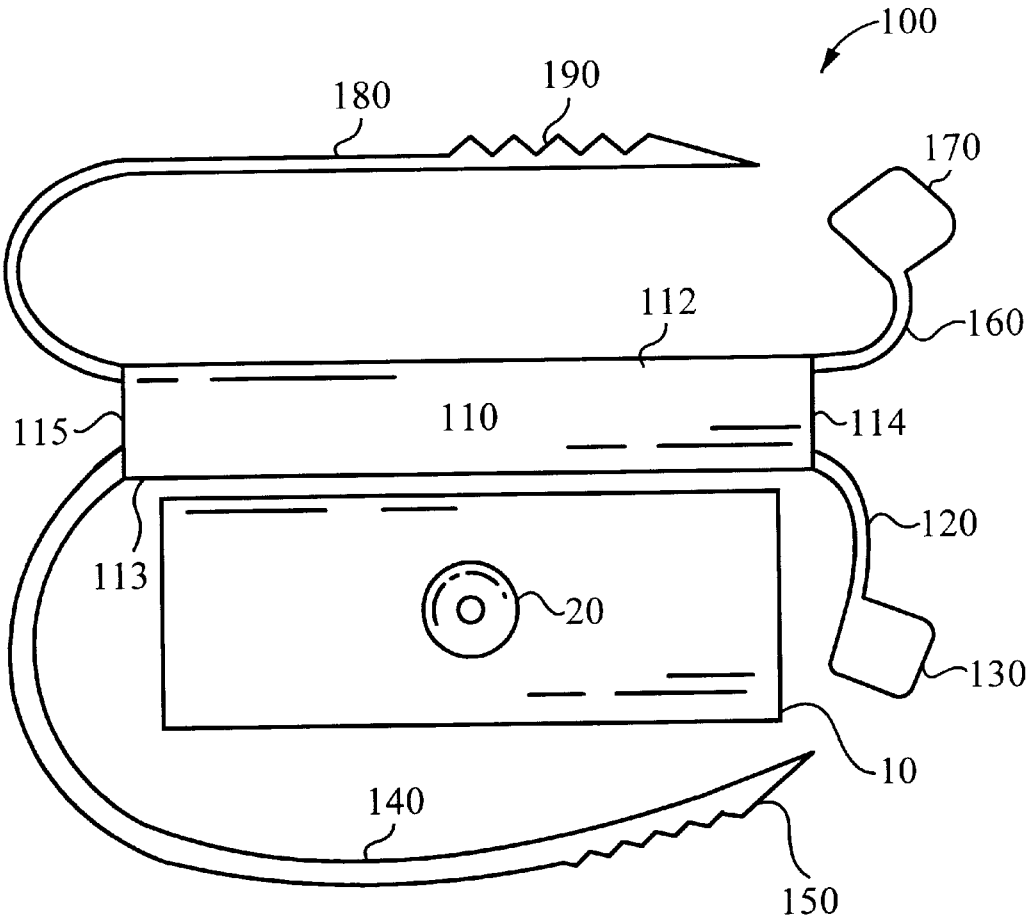
FIG. 1 illustrates a side view of an universal adapter of the present invention.

FIG. 1 illustrates the universal adapter 100 of the present invention. The universal adapter 100 is preferably configured to releasably couple to a pedal 10. The pedal 10 preferably rotates around an axle 20 in either a clockwise or counter-clockwise direction. The universal adapter 100 is also preferably configured to releasably couple to either the foot holder 200 (FIG. 2), the linear connector 300 (FIG. 3), or the curved connector 400 (FIG. 4). The universal adapter 100 preferably includes a first pedal strap 140, a second pedal strap 120, an apparatus latch 170, a first apparatus strap 180, a second apparatus strap 160, a pedal latch 130, and a body 110. The body 110 preferably has a first side 112, a second side 113, a third side 114, and a fourth side 115.

It is important to note that the pedal 10 and the axle 20 are only shown for exemplary purposes and are not part of the present invention. The pedal 10 and corresponding axle 20 represent a foot pedal of a stationary bicycle (not shown). Further, the universal adapter 100 is configured to releasably couple to a variety of pedals with differing shapes.

The first apparatus strap 180 is preferably attached to the fourth side 115 of the body 110. The first apparatus strap 180 also includes a connecting end 190 for releasably coupling with the apparatus latch 170. A first end of the second apparatus strap 160 is coupled to the third side 114 of the body 11O. A second end of the second apparatus strap 160 is preferably coupled to the apparatus latch 170. The connecting end 190 and the apparatus latch 170 are preferably configured to releasably connect with each other. The connecting end 190 is shown having a plurality of ridges. The apparatus latch 170 is configured to releasably couple to one of the plurality of ridges such that the apparatus latch 170 and the connecting end 190 are coupled together. This allows an effective length of the connected strap between the fourth side 115 and the third side 114 of the body 110 to be adjusted. To disengage the connecting end 190 from the apparatus latch 170, the user preferably depresses a portion of the apparatus latch 170. This prevents the connecting end 190 from accidentally disengaging from the apparatus latch 170.

The apparatus latch 170 is configured to engage the connecting end 190 such that the first apparatus strap 180 and the second apparatus strap 160 are coupled together. While coupled, the first apparatus strap 180 and the second apparatus strap 160 are configured to surround and securely retain the external device such as the first foot holder 200 (FIG. 2), the first linear connector 300 (FIG. 3), or the first curved connector 400 (FIG. 4), against the first surface 112 of the body 110.

In use, to initiate the engagement of the apparatus latch 170 and the connecting end 190, the connecting end 190 is fed through the apparatus latch 170 wherein the apparatus latch 170 connects to one of the plurality of ridges on the connecting end 190. As a result, once the apparatus latch 170 connects to any one of the plurality of ridges on the connecting end 190, the first apparatus strap 180 and the second apparatus strap 160 are coupled together.

While coupled, the distance between the connection point of the first apparatus strap 180 to the body 110 and the connection point of the second apparatus strap 160 to the body 110 is the effective length of the combined straps. This effective length of the first apparatus strap 180 and the second apparatus strap is shortened by feeding the connecting end 190 further through the apparatus latch 170. The apparatus latch 170 is preferably configured to allow the connecting end 190 to continue to feed through the apparatus latch 170, thus shortening the effective length of the first and second apparatus straps 180 and 160. In addition, the apparatus latch 170 preferably prevents the connecting end 190 from exiting the apparatus latch 170 without direction from the user. As a result, the first and second apparatus straps are releasably ccupled together, and the effective length of the first and second apparatus strap is adjustable by the user.

The first pedal strap 140 is preferably and securely attached to the fourth side 115 of the body 110. The first pedal strap 140 also includes a connecting end 150 for releasably coupling with the pedal latch 130. A first end of the second pedal strap 120 is attached to the third side 114 of the body 10. A second end of the second pedal strap 120 is preferably coupled to the pedal latch 130. The connecting end 150 and the pedal latch 130 are preferably configured to releasably connect with each other. The connecting end 150 is shown having a plurality of ridges. The pedal latch 130 is configured to releasably couple to one of the plurality of ridges such that the pedal latch 130 and the connecting end 150 are coupled together. Further, the pedal latch 130 preferably prevents the connecting end 150 from accidentally disengaging.

In use, to initiate the engagement of the pedal latch 130 and the connecting end 150, the connecting end 150 is fed through the pedal latch 130 wherein the pedal latch 130 connects to one of the plurality of ridges on the connecting end 150. As a result, once the pedal latch 130 connects to any one of the plurality of ridges on the connecting end 150, the first pedal strap 140 and the second pedal strap 120 are coupled together.

While coupled, the distance between a connection point of first pedal strap 140 to the body 110 and the connection point of the second pedal strap 120 to the body 110 is the effective length. This effective length of the first pedal strap 140 and the second pedal strap 120 is shortened by feeding the connecting end 150 further through the pedal latch 130. The pedal latch 130 is preferably configured to allow the connecting end 150 to continue to feed through the pedal latch 130, thus shortening the effective length of the first and second pedal straps 140 and 120. In addition, the pedal latch 130 preferably prevents the connecting end 150 from disengaging the pedal latch 130 without direction from the user. As a result, the first and second pedal straps are releasably coupled together, and the effective length of the first and second pedal straps is adjustable by the user.

Although not shown, the connecting end 150 with the pedal latch 130 and the connecting end 190 with the apparatus latch 170 may utilize a hook/loop fabric or other means for fastening.

Figure 2:
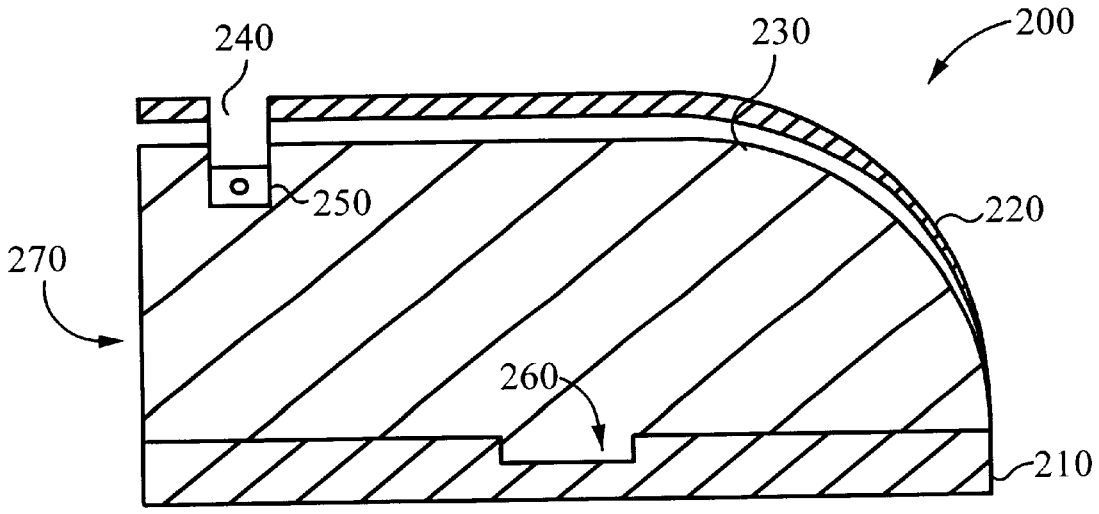
FIG. 2 illustrates a side view of a foot holder of the present invention for coupling with the universal adapter.

FIG. 2 illustrates the foot holder 200 which is configured to removably couple with the universal adapter 100. The foot holder 200 is also configured to selectively and securely retain a foot belonging to a user. The foot holder 200 includes a base 210, an upper shell 220, a right side shell 230, a strap 240, and a right fastener 250.

The base 210 is preferably formed from a semi-rigid material such as plastic, cork, fiberboard, and the like. A channel 260 runs through the base 210 which allows the first apparatus strap 180 (FIG. 1) to pass through the first foot holder 200 and securely attach the base 210 to the first surface 112 of the body 110 (FIG. 1). The right side shell 230 and the upper shell 220 are coupled to the base 210. Although not shown in FIG. 2, there is a left side shell similar to the right side shell 230 that is coupled to the base 210 located behind the right side shell 230 in FIG. 2. The right fastener 250 and a left fastener (not shown) are coupled to the right side shell 230 and the left side shell (not shown), respectively. Further, the strap 240 is preferably connected to the top shell 220 such that the strap 240 is capable of releasably coupling to the left side shell and the right side shell 230 via the left fastener (not shown) and the right fastener 250, respectively. In the alternative, the strap 240 connects to the left side shell, contacts the upper shell 220, and releasably couples with the right side shell 230 via the right fastener 250.

In use, the foot holder 200 allows the user's foot to be placed within the foot holder 200 through an opening 270. Once the user's foot is within the opening 270, the user is capable of tightening the strap 240 via a combination of the right fastener 250 and the left fastener or via solely the right fastener 250 such that the foot holder 200 comfortably and firmly cradles the user's foot. To remove the user's foot from the first foot holder 200, the right fastener 250 is configured to release the strap 240 to free the user's foot.

Although not shown, the right fastener 250, the left fastener, and the strap 240 may utilize a hook/loop fabric, a ridge connector, or other means for fastening.

Figure 3:
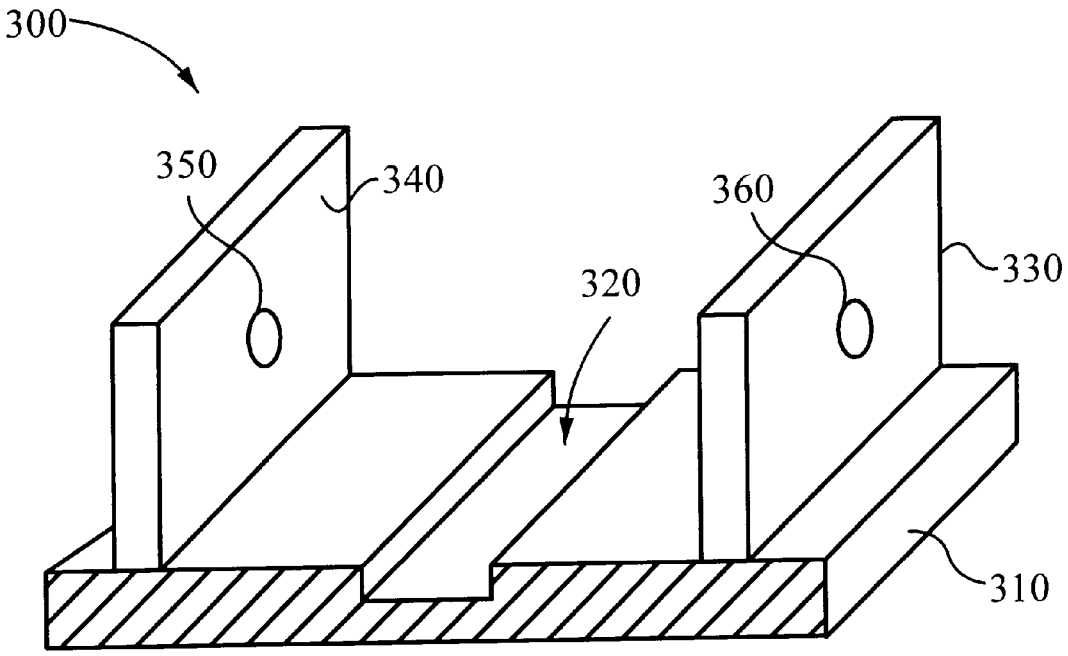
FIG. 3 illustrates a perspective view of a linear connector of the present invention for coupling with the universal adapter.
Figure 4:
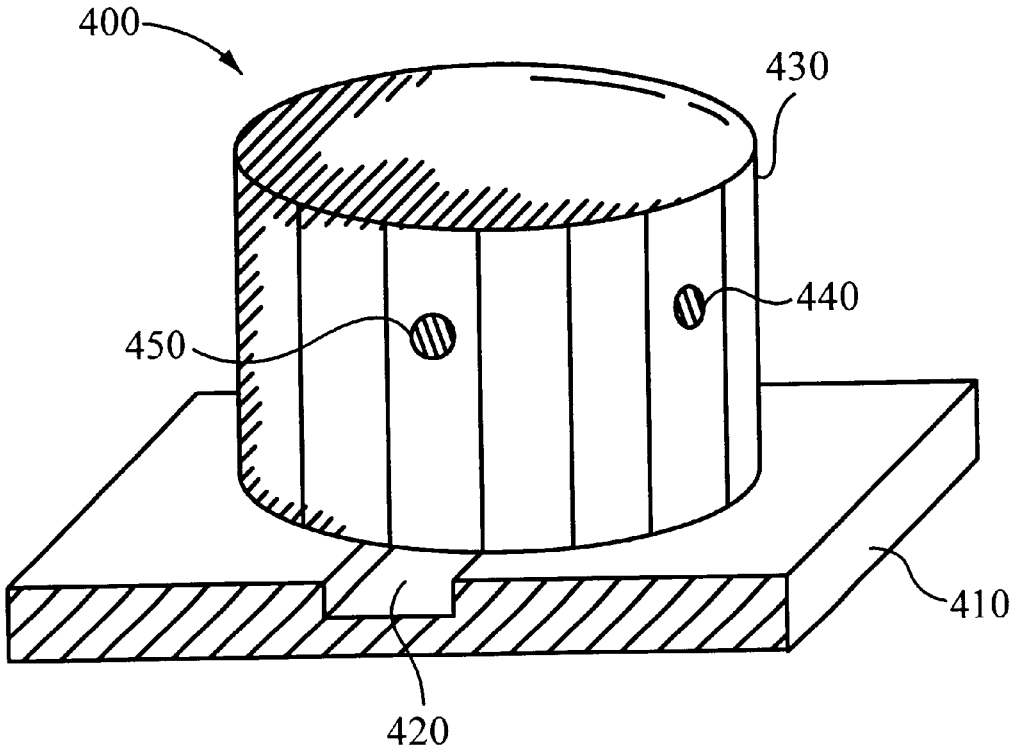
FIG. 4 illustrates a perspective view of a curved connector of the present invention for coupling with the universal adapter.

FIG. 3 illustrates the linear connector 300 which is preferably configured to removably couple with the universal adapter 100 (FIG. 1). The linear connector 300 also preferably couples to an external device such as the first attachment 800 (FIG. 8) and the second attachment 900 (FIG. 9) The linear connector 300 preferably includes a base 310, a right support 330, a left support 340, a right hole 360, a left hole 350, and a channel 320.

Similar to the universal adapter 100 (FIG. 1), the base 310 is also preferably formed from a semi-rigid material such as plastic, cork, fiberboard, and the like. A channel 320 runs along a surface of the base 310 such that the first apparatus strap 180 (FIG. 1) is capable of securing the base 310 to the first surface 112 of the body 110 (FIG. 1).

The right support 330 and the left support 340 are preferably coupled to the base 310. The right support 330 and the left support 340 preferably parallel to each other. The right hole 360 extends through the right support 330. Similarly, the left hole 350 extends through the left support 340). The right and left supports 330 and 340 along with the corresponding right and left holes 360 and 350 are preferably configured to securely couple the external device to the linear connector 300. In use, the location of the right support 330 and the left support 340 preferably correspond to an attachment portion of the external device. Further, the right and left holes 360 and 350 allow the attachment portion of the external device to securely attach to the linear connector 300.

FIG. 4 illustrates the curved connector 400 which is preferably configured to removably couple with the universal adapter 100. The first curved connector 400 preferably couples to an external device such as the first attachment 800 (FIG. 8) and the second attachment 900 (FIG. 9). The first curved connector 400 preferably includes a base 410, a support 430, a first hole 440, a second hole 450, and a channel 420.

Similar to the universal adapter 100 (FIG. 1), the base 410 is also preferably formed from a semi-rigid material such as plastic, cork, fiberboard, and the like. A channel 420 runs along a surface of the base .410 such that the first apparatus strap 180 (FIG. 1) is capable of securing the base 41 to the first surface 112 of the body 110 (FIG. 1).

The support 430 is preferably coupled to the base 410. The support 430 is preferably substantially curved. The support 430 is shown in FIG. 4 as a cylinder. However, the support 430 may also take a different shape. The first and second holes 440 and 450 preferably extend through the support 430. The support 430 along with the first and second holes 440 and 450 are preferably configured to securely couple the external device to the curved connector 400. In use, the shape of the support 430 preferably corresponds to an attachment portion of the external device. Further, the first and second holes 440 and 450 allow the attachment portion of the external device to securely attach to the curved connector 400.

Figure 5:
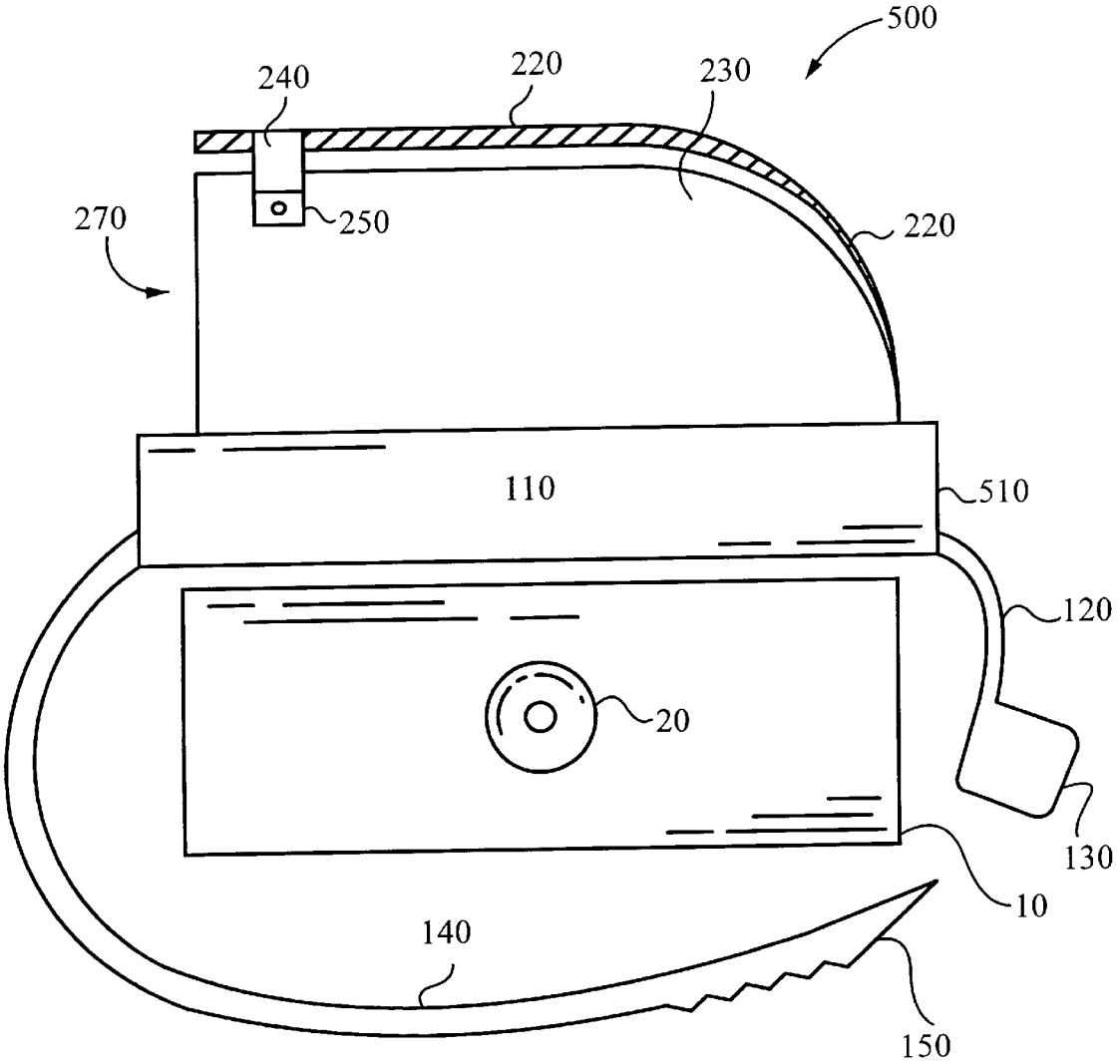
FIG. 5 illustrates a side view of a first alternate embodiment of the present invention comprising the foot holder integrally formed with the universal adapter.

FIG. 5 illustrates a combined foot holder adapter 500 which is the first alternate embodiment of the present invention. For the sake of clarity and simplicity, common elements share common reference numerals. For example, the combined foot holder adapter 500 includes the upper shell 220, right side shell 230, the strap 240, the right fastener 250, and the opening 270 which are shown in FIG. 2 and previously described in context with the foot holder 200. Further, the combined foot holder adapter 500 also includes the second pedal strap 120, the pedal latch 130, the first pedal strap 140, and the connecting end 150 which are shown in FIG. 1 and previously described in context with the universal adapter 100.

In the combined foot holder adapter 500, elements from the universal adapter 100 (FIG. 1) and the foot holder 200 (FIG. 2) are combined to form the adapter 500. However, unlike the universal adapter 100 (FIG. 1) and the foot holder 200 (FIG. 2), the combined foot holder adapter 500 shares a common base 510 and forms a single unit to releasably couple a user's foot to the pedal 10. The common base 510 is preferably comprised of a rigid material such as plastic, cork board, and the like. The combined foot holder adapter 500 is configured to accept a user's foot in the opening 270. Further, the user's foot is held in place by the right side shell 230, the upper shell 220, and the left side shell (not shown), the strap 240, and the right fastener 250. The combined foot adapter 500 is also configured to attach to the pedal 10 by the first pedal strap 140, the second pedal strap 120, the connecting end 150, and the pedal latch 130.

The user may exercise by utilizing either the combined foot holder adapter 500 (FIG. 5) or the universal adapter 100 (FIG. 1) utilized in conjunction with the foot holder 200 (FIG. 2) coupled onto a pedal of a stationary bicycle. The user preferably exerts force via the user's foot and motivates the pedal of the stationary bicycle without riding the stationary bicycle in a conventional manner. In fact, the user preferably stands beside the stationary bicycle on one foot while exerting force on either the combined foot holder adapter 500 (FIG. 5) or the universal adapter 100 (FIG. 1) utilized in conjunction with the foot holder 200 (FIG. 2) with the other foot. The user is capable of applying force to the pedal of the stationary bicycle during both the down-stroke and up-stroke of the pedal rotation.

Figure 6:
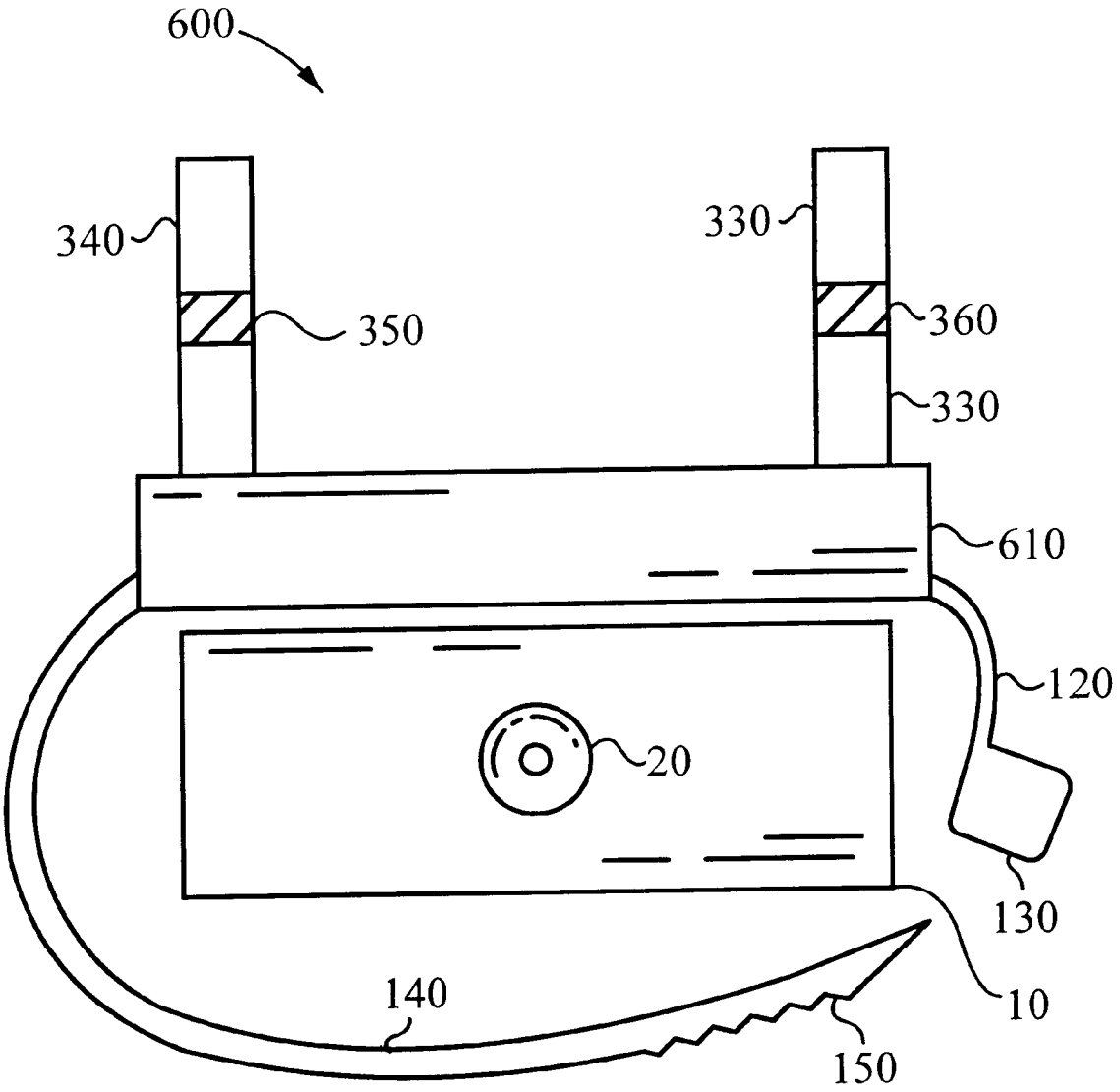
FIG. 6 illustrates a side view of a second alternate embodiment of the present invention comprising the linear connector integrally formed with the universal adapter.

FIG. 6 illustrates a combined linear connector adapter 600 which is the second alternate embodiment of the present invention. For the sake of clarity and simplicity, common elements share common reference numerals. For example, the combined linear connector adapter 600 includes the right support 330, the right hole 360, the left support 340, and the left hole 350 which are shown in FIG. 3 and previously described in context with the linear connector 300. Further, the combined linear connector adapter 600 also includes the second pedal strap 120, the pedal latch 130, the first pedal strap 140, and the connecting end 150 which are shown in FIG. 1 and previously described in context with the universal adapter 100.

In the combined linear connector adapter 600, elements from the universal adapter 100 (FIG. 1) and the linear connector 300 (FIG. 3) are combined to form the adapter 600. However, unlike the universal adapter 100 (FIG. 1) and the linear connector 300 (FIG. 3), the combined linear connector adapter 600 shares a common base 610 and forms a single unit to releasably couple a linear connector to the pedal 10. The common base 610 is preferably comprised of a rigid material such as plastic, cork board, and the like. The combined linear connector adapter 600 is configured to selectively and releasably retain a square or substantially rectangular connector by the right support 330, the right hole 360, the left support 340, and the left hole 350. The combined linear connector adapter 600 is also configured to attach to the pedal 10 by the first pedal strap 140, the second pedal strap 120, the connecting end 150, and the pedal latch 130.

Figure 7:
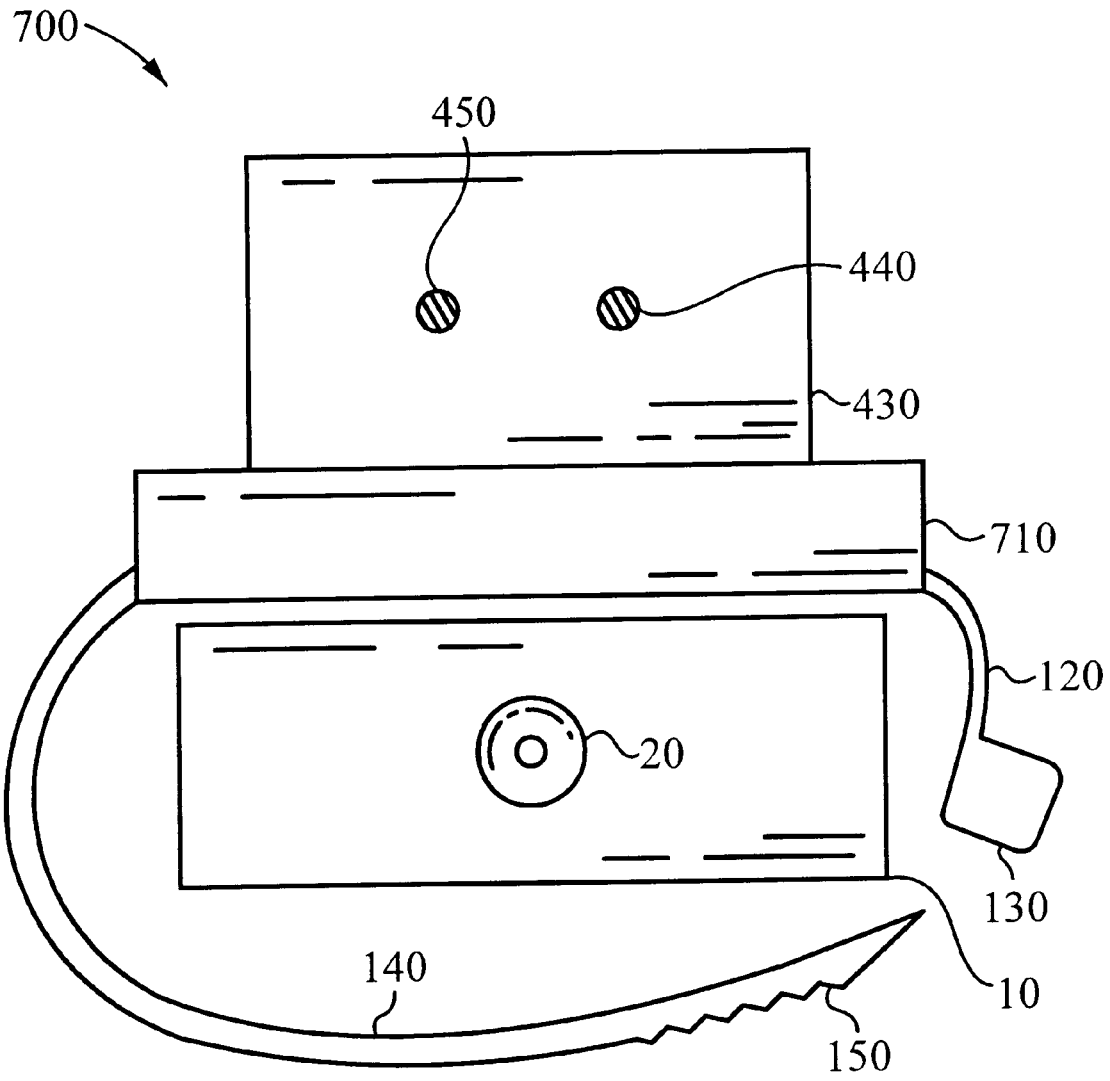
FIG. 7 illustrates a side view of a third alternate embodiment of the present invention comprising the curved connector integrally formed with the universal adapter.

FIG. 7 illustrates a combined curved connector adapter 700 which is the third alternate embodiment of the present invention. For the sake of clarity and simplicity, common elements share common reference numerals. For example, the combined curved connector adapter 700 includes the curved support 430, the first hole 440, and the second hole 450 which are shown in FIG. 4 and previously described in context with the curved connector 400. Further, the combined curved connector adapter 700 also includes the second pedal strap 120, the pedal latch 130, the first pedal strap 140, and the connecting end 150 which are shown in FIG. 1 and previously described in context with the universal adapter 100.

In the combined curved connector adapter 700, elements from the universal adapter 100 (FIG. 1) and the curved connector 400 (FIG. 4) are combined to form the adapter 700. However, unlike the universal adapter 100 (FIG. 1) and the curved connector 400 (FIG. 4), the combined cursed connector adapter 700 shares a common base 710 and forms a single unit to releasably couple a curved connector to the pedal 10. The common base 710 is preferably comprised of a rigid material such as plastic, cork board, and the like. The combined curved connector adapter 700 is configured to selectively and releasably retain a substantially curved connector by the curved support 430, the first hole 440, and the second hole 450. The combined curved connector adapter 700 is also configured to attach to the pedal 10 by the first pedal strap 140, the second pedal strap 120, the connecting end 150, and the pedal latch 130.

Figure 8:
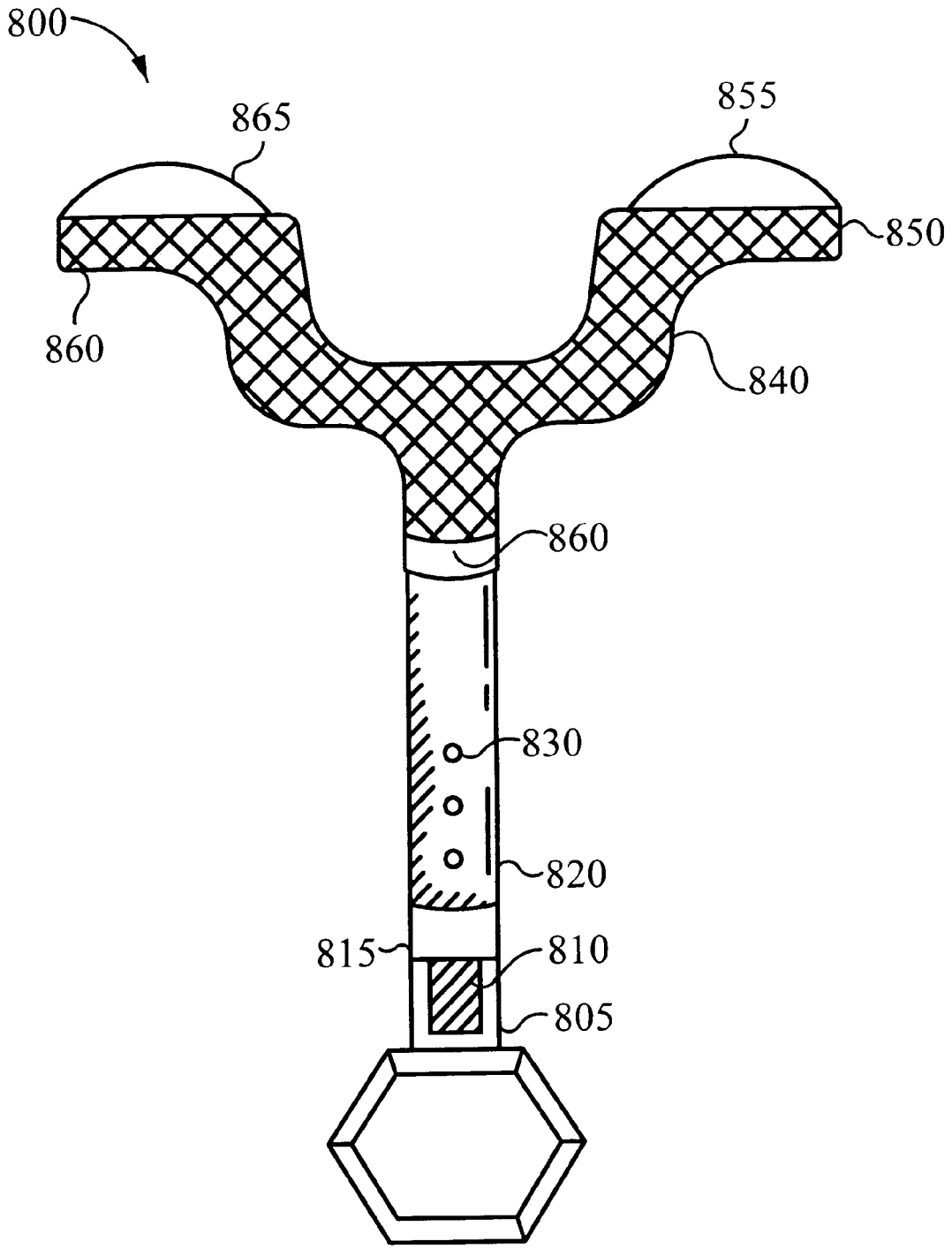
FIG. 8 illustrates a front view of a first attachment of the present invention.
Figure 9:
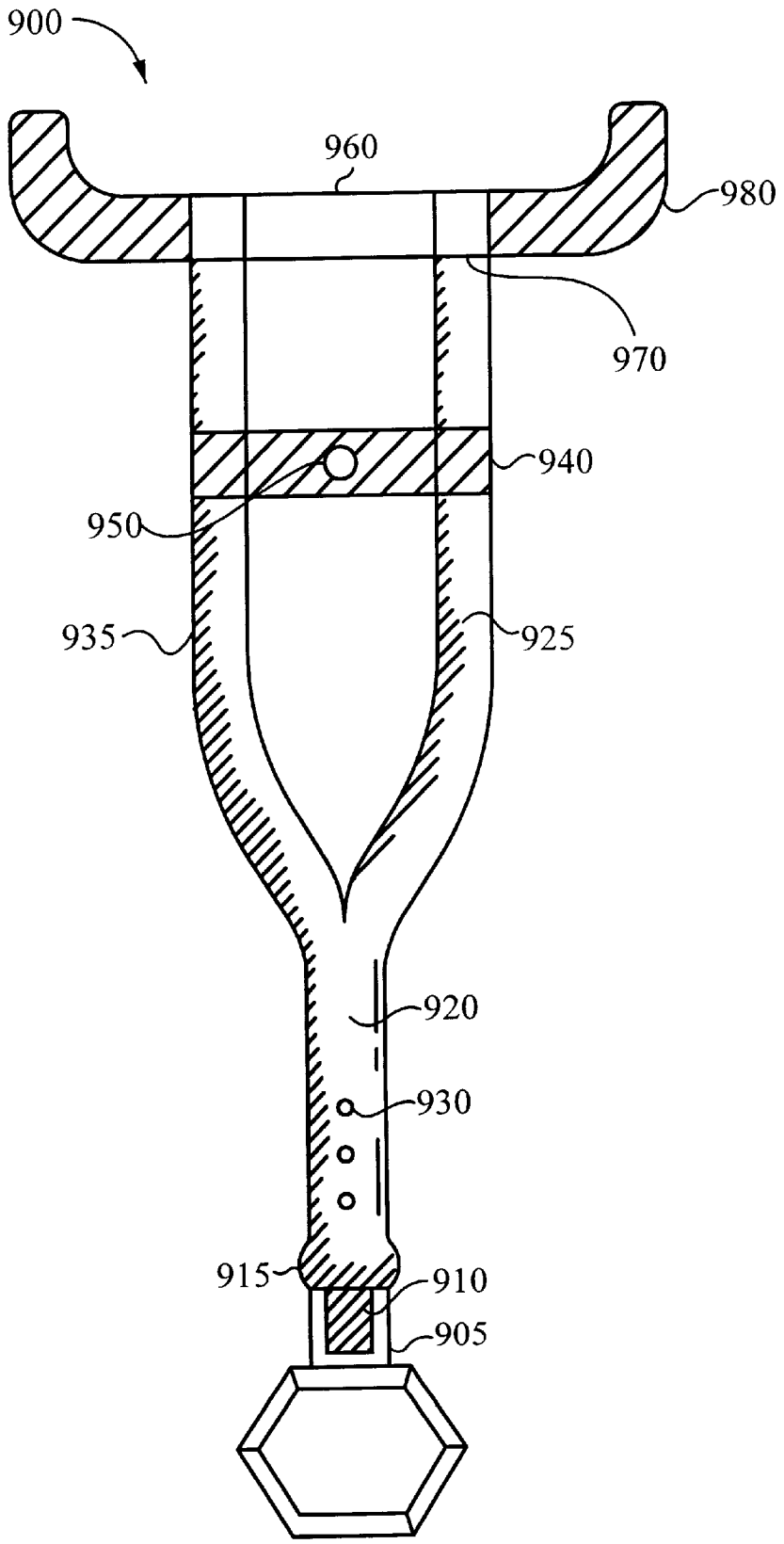
FIG. 9 illustrates a front view of a second attachment of the present invention.

FIG. 8 illustrates the first attachment 800 of the present invention. The first attachment 800 is preferably configured to couple with a connector 805 wherein the connector 805 preferably couples the first attachment 800 to a bicycle pedal (not shown). The connector 805 may be a combination of the universal adapter 100 (FIG. 1) in conjunction with the linear connector 300 (FIG. 3) or the curved connector 400 (FIG. 4). The connector 805 may also be the combined linear connector adapter 600 (FIG. 6) or the combined curved connector adapter 700 (FIG. 7). The first attachment 800 allows the user to exert force onto the coupled bicycle pedal via a single leg, both legs, a single arm, or both arms of the user. Preferably, this coupled bicycle pedal belongs to a stationary bicycle. The first attachment 800 preferably includes an interface connector 810, a pivot rotator 815, a support column 820, a plurality of holes 830, a rotatable coupler 860, a handlebar 840, a right handle 850, a right strap 855, a left handle 860, and a left strap 865.

The interface connector 810 is configured to removably couple to the connector 805. The user is capable of securely attaching the interface connector 810 to the connector 805. If the interface connector 810 exerts an amount of force above a predetermined threshold when the interface connector 810 and the connector 805 are coupled together, the interface connector 810 automatically disengages the connector 805. The connector 810 is slidably coupled to the support column 820. The connector 810 can be configured to slide either inside or outside the support column 820. The connector 810 preferably engages one of the plurality of holes 830 within a proximate end of the support column 820. The overall height of the first attachment 800 can be adjusted by engaging the connector 810 with a particular one of the plurality of holes 830. The pivot rotator 815 forms a portion of the connector 810 such that the pivot rotator 815 allows the supporting column 820 to pivot relative to the connector 805.

A distal end of the support column 820 is coupled to a first terminal of the rotatable coupler 860. A second terminal of the rotatable coupler 860 is coupled to the handlebar 840. The rotatable coupler 860 is preferably configured to allow the handlebar 840 to rotate around the axis of the support column 820.

The right handle 850 and the left handle 860 form a portion of the handlebar 840 and are configured to contact the user's arms, legs, hands or feet. The right strap 855 and the left strap 865 are located in proximity to the right handle 850 and the left handle 860, respectively, and aid the user to remain in contact with the right and left handles 850 and 860.

During use, the first attachment 800 is preferably coupled to the connector 805 which is linked to a pedal belonging to a stationary bicycle. The user is capable of adjusting the height of the first attachment by selectively engaging the connector 810 with one of the plurality of holes 830 on the supporting column 820. Further, the right and left handles 850 and 860 along with the right and left straps 855 and 865 are configured to direct force exerted by the user's hands or feet to the pedal of the stationary bicycle. The pivot rotator 815 allows the supporting column 820 to pivot about the connector 805, and the rotatable coupler 860 allows the handlebar 840 to rotate around the axis of the supporting column 820. As a result, the first attachment 800 allows the user to exert force onto the pedal of the stationary bicycle through the user's legs, arms, hands, or feet in a variety of positions without riding the stationary bicycle in a conventional manner. The first attachment 800 allows the user to exert force onto the pedal of the stationary bicycle during both the down-stroke and up-stroke of the pedal rotation.

FIG. 9 illustrates the second attachment 900 of the present invention. The second attachment 900 is preferably configured to couple with a Connector 905 wherein the connector 905 preferably couples the second attachment 900 to a bicycle pedal (not shown). The connector 905 may be a combination of the universal adapter 100 (FIG. 1) in conjunction with the linear connector 300 (FIG. 3) or the curved connector 400 (FIG. 4). The connector 905 may also be the combined linear connector adapter 600 (FIG. 6) or the combined curved connector adapter 700 (FIG. 7). The second attachment 900 allows the user to exert force onto the coupled bicycle pedal via the user's legs or arms. Preferably, this coupled bicycle pedal belongs to a stationary bicycle. The second attachment 900 preferably includes an interface connector 910, a ball joint 915, a support column 920, a support brace 940, a light emitting diode (LED) pointer 950, a right fork 925, a left fork 935, a handlebar 960, and a swivel 970.

A first end of the interface connector 910 is configured to removably couple to the connector 905. A second end of the interface connector 910 is slidably coupled to the support column 920. The second end of the interface connector 910 preferably engages one of the plurality of holes 930 within a proximate end of the support column 920. The overall height of the second attachment 900 can be adjusted by engaging the connector 905 with a particular one of the plurality of holes 930 within the support column 920. The ball joint 915 forms a part of the interface connector 910 and is located between the first and second ends. The ball joint 915 allows the supporting column 920 to rotate along two perpendicular axes relative to the connector 905.

A distal end of the support column 920 is coupled to proximate ends of the right fork 925 and the left fork 935. The support brace 940 is preferably coupled between the right fork 925 and the left fork 935 to provide support to the second attachment 900 and to retain the LED pointer 950. The LED pointer 950 provides a visual guide for the user while the second attachment 900 is in use. The swivel 970 is mounted between distal ends of the right fork 925 and the left fork 935 and the handlebar 960. The swivel 970 preferably allows the handlebar 960 to selectively rotate relative to the right fork 925 and the left fork 935.

During use, the second attachment 900 is preferably coupled to the connector 905 which is linked to a pedal belonging to a stationary bicycle. Similar to the first attachment 800 (FIG. 8), the user is capable of adjusting the height of the first attachment by selectively engaging the interface connector 910 with one of the plurality of holes 930 on the supporting column 920. Further, the handlebar 960 along with an extension 980 are configured to direct force exerted by the user to the pedal of the stationary bicycle. The ball joint 915 allows the supporting column 920 to rotate in an infinite number or positions about the interface connector 905. The swivel 970 allows the handlebar 960 and the extension 980 to rotate around relative to the right and left forks 925 and 935. As a result, the second attachment 900 allows the user to exert force onto the pedal of the stationary bicycle through the user's arms, legs, hands, or feet in a variety of positions without riding the stationary bicycle in a conventional manner. The second attachment 900 allows the user to exert force onto the pedal of the stationary bicycle during both the down-stroke and up-stroke of the pedal rotation.

The present invention allows the user to exercise a variety of muscle groups in an efficient manner. For example, the user simply securely attaches the universal adapter 100 (FIG. 1) onto the pedal of the stationary bicycle. The universal adapter 100 is capable of being adjusted to accommodate a wide variety of pedal sizes. Next, the user securely couples either the foot holder 200 (FIG. 2), the linear connector 300 (FIG. 3), or the curved connector 400 (FIG. 4); the universal adapter 100 is capable of interchangeably coupling with any of these devices. If the foot holder 200 is coupled to the universal adapter 100, then the user may begin exercising. However, if either the linear connector 300 or the curved connector 400 is coupled to the universal adapter 100, then the user can securely couple either the first attachment 800 (FIG. 8) or the second attachment (FIG. 3) onto the chosen connector. After either the first attachment 800 or the second attachment 900 is coupled to the connector, the user may begin exercising.

In the alternative, the user simply securely attaches either the combined foot holder adapter 500 (FIG. 5), the combined linear connector adapter 600 (FIG. 6), or the combined curved connector adapter 700 (FIG. 7) onto the pedal of the stationary bicycle. The foot holder adapter 500, the combined linear connector adapter 600, and the combined curved connector adapter 700 are capable of being adjusted to accommodate a wide variety of pedal sizes. If the foot holder adapter 500 is coupled to the pedal, then the user may begin exercising. However, if either the combined linear connector adapter 600 or the combined curved connector adapter 700 is coupled to the pedal, then the user can securely couple either the first attachment 800 or the second attachment onto the chosen connector. After either the first attachment 800 or the second attachment 900 is coupled to the connector, the user may begin exercising.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiments chosen for illustration without departing from the spirit and scope of the invention.

Specifically, it will be apparent to one of ordinary skill in the art that the device of the present invention could be implemented in several different ways and the apparatus disclosed above is only illustrative of the preferred embodiment of the invention and is in no way a limitation. For example, it would be within the scope of the invention to vary the fastening means disclosed herein. It will be apparent that fastening means of one type, such as quick-release and hook/latch fabric can be substituted for each other and so forth.

What is claimed is:

1. An adapter for coupling a user interface to a pedal of a stationary exercise bicycle wherein the user actuates the rotation of the pedal by applying a force perpendicular to the rotational axis of the pedal from the user interface and through the adapter, the adapter comprising:

a) a user interface;

b) a body with a first side and a second side, the body being sized to fit a bicycle pedal;

c) a first fastener connected to the body for selectively coupling the first side of the body to the user interface;

d) a second fastener connected to the body for selectively coupling the second side of the body to said bicycle pedal; and e) said fasteners are one of a plurality of hook/loop, ridge/latch fasteners, and buckle strap fasteners.

2. An adapter as claimed in claim 1, wherein the adapter allows a user to pedal a stationary exercise bicycle with one foot while dismounted from the exercise bicycle, and the user interface comprises a foot holder coupled to the first side of the body, the foot holder being configured for inserting a user's foot and allowing the user to apply both an upward and downward force on the pedal through the adapter.

3. The adapter as claimed in claim 2, wherein the foot holder is coupled to the first side of the body through the first fastener.

4. An exercise system comprising:

a) an adapter for coupling a user interface to a pedal of a stationary exercise bicycle wherein the user actuates the rotation of the pedal by applying a force perpendicular to the rotational axis of the pedal from the user interface and through the adapter, the adapter comprising:

a body with a first side and a second side;

c) said body having a first fastener that holds a connector for detachably coupling the first side of the body to a user interface;

d) a user interface configured to allow the user to exercise a portion of the user's body by applying a force to the user interface to rotate the pedal of a stationary exercise bicycle; and e) a second fastener connected to the body configured for detachably coupling the second side of the body to a bicycle pedal.

5. The exercise system as claimed in claim 4, wherein the second fastener is a buckle/strap fastener that loops around the pedal.

6. The exercise system as claimed in claim 4, further comprising a first fastener for coupling the first side of the body through a connector.

7. The exercise system as claimed in claim 6, wherein the fastener is selected from a group consisting of a hook/loop fastener, a ridge/latch fastener, and a buckle/strap fastener.

8. The exercise system as claimed in claim 4, wherein the user interface comprises a pivot coupled between a handle and the connector configured for changing the distance between the handle and the connector.

9. The exercise system as claimed in claim 8, wherein the user interface further comprises a strap coupled to the handle configured to assist a user.

10. The exercise system as claimed in claim 8, wherein the user interface further comprises means for rotating that is coupled between the handle and the connector to allow the handle to rotate with respect to the connector.

* * * * *

UNITED STATES PATENT AND TRADEMARK OFFICE

CERTIFICATE OF CORRECTION

PATENT NO. : 6,142,916
DATED : November 7, 2000
INVENTOR(S) : Richard H. Byrd

It is certified that error appears in the above-identified patent and that said Letters Patent is hereby corrected as shown below:

IN THE TITLE

Replace "Variable Rotational Exercise System" with -- An Exercise Device Adaptable for a Stationary Exercise Bicycle and Method for Using the Same--.

IN THE ABSTRACT

Replace "An exercise system and method is utilized with a foot pedal of a stationary bicycle to exercise various body parts including the user's legs, arms, chest, shoulders, back, and abdomen for a complete body workout. The exercise system preferably includes an adapter and a plurality of user interfaces. The adapter is configured to releasably couple one of the foot pedals of the stationary bicycle and one of the plurality of user interfaces. A foot holder serves as one of the plurality of user interfaces. Preferably, the foot holder securely and releasably retains the user's foot. While in use, the user's foot is axially aligned with an axle of the foot pedal and is capable of supplying force to the foot pedal on both the down-stroke and up-stroke portions of the foot pedal's rotation. An external attachment also serves as one of the plurality of user interfaces. The external attachment is preferably designed to transmit force from the user's legs, arms, feet, or hands to the foot pedal of the stationary bicycle. Additionally, the external attachment can also transmit force from the user's legs, arms, feet, or hands to this foot pedal. Similar to the foot holder, the external attachment is also capable of supplying force to the foot pedal on both the down-stroke and up-stroke portions of the foot pedal's rotation."

with--An exercise device is adapted for use with a stationary exercise bicycle. The device allows a user to exercise various body parts including the user's legs, arms, chest, shoulders, back, and abdomen for a complete body workout through the pedaling action of the stationary exercise bicycle. The device is attached to a pedal of the stationary exercise bicycle with a universal adapter. The user rotates the crank shaft of the stationary exercise bicycle through the adapter by applying an upward and downward force to a user interface that is connected to the adapter. The user interface is preferably detachably connected to the adapter through a connector so that user interfaces can be quickly changed without removing the adapter from the pedal of the stationary exercise bicycle.

It is certified that error appears in the above-identified patent and that said Letters Patent is hereby corrected as shown below:

Preferably, the adapter is connected to the pedal of the stationary exercise bicycle with an adjustable buckle/strap fastener that easily wraps around and secures to pedals having various shapes and sizes. The exercise device is free standing and does not require any attachment to the stationary exercise bicycle other than the attachment of the adapter to the pedal. Users are free to exercise with the device using the pedaling action of the stationary exercise bicycle while being dismounted from the stationary exercise bicycle. In one embodiment of the invention, the adapter is configured with foot holder that allows the user to pedal the stationary exercise bicycle with one foot while standing dismounted from the stationary exercise bicycle.--.

IN THE SPECIFICATION

Column 3,
Line 60, after "the body", replace "10" with --110--.

Column 4,
Line 11, after "between" and before "connection point", change "a" to --the--.
Line 12, after "of" and before "first pedal", insert --the--.

UNITED STATES PATENT AND TRADEMARK OFFICE

CERTIFICATE OF CORRECTION

PATENT NO. : 6,142,916
DATED : November 7, 2000
INVENTOR(S) : Richard H. Byrd

It is certified that error appears in the above-identified patent and that said Letters Patent is hereby corrected as shown below:

Column 5,
Line 42, after "securing the base", replace "41" with --410--.

Column 9,
Line 31, after "second attachment", replace "(FIG.3)" with (FIG.9)--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*